US006759356B1

(12) United States Patent
Myers

(10) Patent No.: US 6,759,356 B1
(45) Date of Patent: Jul. 6, 2004

(54) FIBROUS ELECTRET POLYMERIC ARTICLES

(75) Inventor: David Lewis Myers, Cumming, GA (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 0 days.

(21) Appl. No.: 09/340,771

(22) Filed: Jun. 28, 1999

Related U.S. Application Data

(60) Provisional application No. 60/091,225, filed on Jun. 30, 1998.

(51) Int. Cl.[7] ..... D04H 1/00; D04H 13/00; D04H 3/16

(52) U.S. Cl. ..... 442/351; 442/361; 442/400; 442/401; 442/414

(58) Field of Search ..... 442/351, 361, 442/414

(56) References Cited

U.S. PATENT DOCUMENTS

| | | | | |
|---|---|---|---|---|
| 3,016,599 | A | 1/1962 | Perry, Jr. | |
| 3,341,394 | A | 9/1967 | Kinney | |
| 3,655,862 | A | 4/1972 | Dorschner et al. | |
| 3,692,618 | A | 9/1972 | Dorschner et al. | |
| 3,704,198 | A | 11/1972 | Prentice | |
| 3,705,068 | A | 12/1972 | Dobo et al. | |
| 3,745,142 | A | 7/1973 | Mahlman | |
| 3,746,142 | A | 7/1973 | Hepp et al. | |
| 3,755,527 | A | 8/1973 | Keller et al. | |
| 3,767,444 | A | 10/1973 | Zeisberger | |
| 3,802,817 | A | 4/1974 | Matsuki et al. | 425/66 |
| 3,849,241 | A | 11/1974 | Butin et al. | 161/169 |
| 3,853,651 | A | 12/1974 | Porte | |
| 3,959,421 | A | 5/1976 | Weber et al. | 264/6 |
| 3,978,185 | A | 8/1976 | Buntin et al. | |
| 4,002,779 | A | 1/1977 | Nischwitz | |
| 4,041,203 | A | 8/1977 | Brock et al. | 428/157 |
| 4,064,605 | A | 12/1977 | Akiyama et al. | |
| 4,091,140 | A | 5/1978 | Harmon | |
| 4,100,319 | A | 7/1978 | Schwartz | |
| 4,100,324 | A | 7/1978 | Anderson et al. | 428/288 |
| 4,118,531 | A | 10/1978 | Hauser | |
| 4,215,682 | A | 8/1980 | Kubik et al. | 128/205.29 |
| 4,229,187 | A | 10/1980 | Stockford et al. | 55/14 |
| 4,308,223 | A | 12/1981 | Stern | |
| 4,315,881 | A | 2/1982 | Nakajima et al. | 264/171 |
| 4,340,563 | A | 7/1982 | Appel et al. | 264/518 |
| 4,342,849 | A | 8/1982 | Kennedy | 525/333.7 |
| 4,375,718 | A | 3/1983 | Wadsworth et al. | 29/592 |
| 4,405,297 | A | 9/1983 | Appel et al. | |
| 4,434,204 | A | 2/1984 | Hartman et al. | 428/198 |
| 4,468,432 | A | 8/1984 | Matsukura et al. | 428/328 |
| 4,513,049 | A | 4/1985 | Yamasaki et al. | 428/194 |
| 4,564,721 | A | 1/1986 | Ishikawa et al. | |
| 4,588,537 | A | 5/1986 | Klaase et al. | 264/22 |
| RE32,171 | E | 6/1986 | van Turnhout | 55/155 |
| 4,592,815 | A | 6/1986 | Nakao | 204/165 |
| 4,622,259 | A | 11/1986 | McAmish et al. | 428/171 |
| 4,626,263 | A | 12/1986 | Inoue et al. | 55/155 |
| 4,627,811 | A | 12/1986 | Greiser et al. | |
| 4,644,045 | A | 2/1987 | Fowells | |
| 4,652,282 | A | 3/1987 | Ohmori et al. | 55/155 |
| 4,663,220 | A | 5/1987 | Wisneski et al. | |
| 4,789,504 | A | 12/1988 | Ohmori et al. | 264/22 |
| 4,874,399 | A | 10/1989 | Reed et al. | 55/2 |
| 4,874,659 | A | 10/1989 | Ando et al. | 428/221 |

(List continued on next page.)

FOREIGN PATENT DOCUMENTS

| | | |
|---|---|---|
| EP | 0 623 941 | 8/1997 |
| EP | 0 594 123 | 3/1998 |
| GB | 1042906 | 9/1966 |
| WO | 95/13856 | 5/1995 |
| WO | 96/13319 | 5/1996 |
| WO | 97/07272 | 2/1997 |
| WO | 97/11991 | 4/1997 |
| WO | 97/23246 | 7/1997 |
| WO | 97/44509 | 11/1997 |

OTHER PUBLICATIONS

Japanese Abstract 08–067704.
John Wiley & Sons, Encyclopedia of Polymer Science and Engineering, vol. 16, 1989, pp. 494–554.
Journal of Applied Polymer Science, Studies of Polymer Electrets, vol. 27, 1982, pp. 381–395.
Japanese Abstract 06–313058.
Japanese Abstract 60–126310.
Japanese Abstract 63–085112.
Japanese Abstract 63–202663.
Japanese Abstract 63–288216.
Ferroelectric Polymers, Ch. 11 entitled "Polymer–Ferroelectric Ceramic Composites" by Karol Mazur, pp. 539–610, undated.
"Superfine Thermoplastic Fibers" by V. A. Wente, Industrial and Engineering Chemistry, vol. 48, No. 8, pp. 1342–1346 (1956).
"Manufacture of Superfine Organic Fibers" by V. A. Wente et al., Navy Research Laboratory, Washington, D.C., NRL Report 4364 (111437), May 25, 1994, US Dept. of Commerce, Office of Technical Services.
Encyclopedia of Polymer Science & Engineering, vol. 6, "Emulsion Polymerization to Fibers, Manufacture" pp. 802–821, undated.

*Primary Examiner*—Terrel Morris
*Assistant Examiner*—Christopher Pratt
(74) *Attorney, Agent, or Firm*—Douglas H. Tulley, Jr.; Christos S. Kyriakou; Ralph H. Dean

(57) ABSTRACT

A thermoplastic polymer electret material comprising a porous substrate of a blend of a first thermoplastic polymer, such as a polyolefin or polyamide, and from 0.1% to about 25% by weight, of a compatible telomer. The porous substrate is electrostatically charge and is well suited for use in filter media, sterilization wraps, face masks, dust wipes and the like.

25 Claims, 2 Drawing Sheets

U.S. PATENT DOCUMENTS 4,917,942 A 4/1990 Winters ..... 428/286
4,963,390 A 10/1990 Lipeles et al. ..... 427/110
4,969,457 A 11/1990 Hubbard et al. ..... 128/206.12
5,057,710 A 10/1991 Nishiura et al. ..... 307/400
5,070,223 A 12/1991 Colasante
5,110,620 A 5/1992 Tani et al. ..... 427/40
5,112,677 A 5/1992 Tani et al. ..... 428/240
5,143,767 A 9/1992 Matsuura et al. ..... 428/109
5,165,979 A 11/1992 Watkins et al. ..... 428/113
5,188,885 A 2/1993 Timmons et al. ..... 428/198
5,204,174 A 4/1993 Daponte et al. ..... 428/286
5,238,634 A 8/1993 Fetters et al. ..... 264/184
5,246,637 A 9/1993 Matsuura et al. ..... 264/22
5,256,176 A 10/1993 Matsuura et al. ..... 55/528
5,270,121 A 12/1993 Kissel
5,271,883 A 12/1993 Timmons et al. ..... 264/6
5,288,402 A 2/1994 Yoshida ..... 210/488
5,304,227 A 4/1994 Matsuura et al. ..... 55/524
5,350,620 A 9/1994 Sundet et al. ..... 428/172
5,350,624 A 9/1994 Georger et al. ..... 428/219
5,382,400 A 1/1995 Pike et al. ..... 264/168
5,401,446 A 3/1995 Tsai et al. ..... 264/22
5,405,913 A 4/1995 Harwood et al. ..... 525/245
5,407,581 A 4/1995 Onodera et al. ..... 210/654
5,409,765 A 4/1995 Boettcher et al. ..... 428/224
5,409,766 A 4/1995 Yuasa et al. ..... 428/224
5,411,576 A 5/1995 Jones et al. ..... 95/57
5,429,848 A 7/1995 Ando et al. ..... 428/36.2
5,464,687 A * 11/1995 Sheth ..... 428/286
5,472,481 A 12/1995 Jones et al. ..... 96/15
5,482,765 A 1/1996 Bradley et al. ..... 428/286
5,482,772 A 1/1996 Strack et al. ..... 428/357
5,534,335 A 7/1996 Everhart et al. ..... 428/224
5,540,756 A 7/1996 Hoppitt et al. ..... 95/69
5,554,722 A 9/1996 Eichenauer et al.
5,558,809 A 9/1996 Groh et al. ..... 252/62.54
5,560,992 A 10/1996 Sargent et al. ..... 428/373
5,597,645 A 1/1997 Pike et al. ..... 96/99
5,607,766 A 3/1997 Berger ..... 428/373
5,609,947 A 3/1997 Kamei et al. ..... 428/212
5,610,455 A 3/1997 Allen et al. ..... 307/400
5,614,574 A * 3/1997 Sheth ..... 524/140
5,620,785 A 4/1997 Watt et al. ..... 428/219
5,635,134 A 6/1997 Bourne et al. ..... 422/26
5,645,057 A 7/1997 Watt et al. ..... 128/208.12
5,645,627 A 7/1997 Lifshutz et al. ..... 96/15
5,652,048 A 7/1997 Haynes et al. ..... 442/351
5,658,640 A 8/1997 Berrigan et al. ..... 428/152
5,658,641 A 8/1997 Berrigan et al. ..... 428/152
5,688,157 A 11/1997 Bradley et al. ..... 442/340
5,694,925 A 12/1997 Reese et al. ..... 128/206.19
5,707,735 A * 1/1998 Midkiff et al. ..... 428/373
5,709,735 A * 1/1998 Midkiff et al. ..... 96/17
5,721,180 A 2/1998 Pike et al. ..... 442/346
5,726,107 A 3/1998 Dahringer et al. ..... 442/414
5,765,556 A 6/1998 Brunson ..... 128/206.19
5,817,584 A * 10/1998 Singer et al. ..... 442/345
5,855,784 A 1/1999 Pike et al. ..... 210/505
5,871,845 A 2/1999 Dahringer et al.
5,955,546 A * 9/1999 Bates et al. ..... 525/240
5,968,635 A * 10/1999 Rousseau et al. ..... 428/198
5,976,208 A 11/1999 Rousseau et al.
6,001,299 A 12/1999 Kawabe et al.
6,002,017 A * 12/1999 Rousseau et al. ..... 548/451

* cited by examiner

FIBROUS ELECTRET POLYMERIC ARTICLES

This application claims the benefit of provisional application 60/091,225 filed Jun. 30, 1998.

BACKGROUND OF THE INVENTION

The present invention relates to polymeric electret materials and, more particularly, the present invention relates to polymeric electret filtration materials.

BACKGROUND OF THE INVENTION

Nonwoven fabrics, fibrillated films, and other materials comprising polymeric fibers or fibrils have been utilized in a variety of filtration and/or air-masking type applications. For example, U.S. Pat. No. 5,709,735 to Midkiff et al. discloses the use of a nonwoven web for HVAC (heating, ventilating and air-conditioning) and other air filtration media. PCT Application No. U.S.94/12699 (Publication No. WO95/13856) discloses high-loft multicomponent fiber webs suitable for use in a variety of air filtration applications. Additionally, U.S. Pat. No. 5,855,784 to Pike et al. discloses a variety of conjugate fiber nonwoven webs suitable for use as air and/or liquid filtration media. Further, multilayer laminates have likewise been used in a variety of filtration and/or filtration-like applications, see, for example, U.S. Pat. No. 5,721,180 to Pike et al. and U.S. Pat. No. 4,041,203 to Brock et al.

Filtration materials desirably exhibit the highest filtration efficiency at the lowest possible pressure drop. In this regard, the filtration efficiencies of many filters can be improved, without a corresponding increase in pressure drop, by electrostatically charging the materials in order to impart a charge to the filter media. The use of electrets for filtration applications has been known for some time. The advantage of materials of this type is that the charge on the fibers considerably augments the filtration efficiency without making any contribution to the airflow resistance. Air filtration efficiency varies with the electrostatic charge; however, it is not a direct measure of the quantity or magnitude of charge in the media, It is known that certain dielectric materials can be permanently electrostatically polarized by various means including, for example, under the influence of the electric field. A dielectric becomes an electret when the rate of decay of the field-induced polarization can be slowed down so much that a significant fraction of the polarization is preserved long after the polarizing field has been removed. Such electrets can be made by various methods, e.g. corona charging, triboelectric charging (friction) and so forth. Methods of treating various materials to impart an electrostatic charge are described in U.S. Pat. No. 4,215,682 to Kubic et al., U.S. Pat. No. 4,375,718 to Wadsworth et al., U.S. Pat. No. 4,588,537 to Klaase et al. and U.S. Pat. No. 5,401,446 to Tsai et al. However, the ability to impart an electrostatic charge or field of sufficient initial strength and/or maintaining a desired level of electrostatic charge over time has proven difficult for many materials and, in particular, non-polar materials such as polyolefin fabrics. Moreover, many thermoplastic polymer materials often experience a significant or accelerated degradation in the level of electrostatic charge upon exposure to heat and/or moisture. In this regard, it will be readily appreciated that many filtration materials are exposed to heat and/or moisture such as, for example, HVAC filtration media, sterilization wraps, vacuum bag liners, face masks and so forth.

Various topical treatments have been used as a means to impart and/or improve the stability of electrostatic charges. Additionally, charge stability of nonwoven webs of non-polar polymeric materials has been improved by introducing polar groups onto side-chains and/or the backbone of the non-polar monomer or otherwise grafting unsaturated carboxylic acids thereon such as, for example, as described in U.S. Pat. No. 5,409,766 to Yuasa et al. Further, in an attempt to achieve a stable high charge density others have utilized polymeric materials comprising both polar and non-polar polymers. As an example, U.S. Pat. No. 4,626,263 to Inoue et al. discloses an electret treated film comprising a non-polar polymer and a non-polar polymer modified by grafting or copolymerization with a carboxylic acid, epoxy monomer or silane monomer. However, the use of copolymers or grafted polymers containing polar groups within or otherwise branched from the backbone of the host polymer can result in a polymer that is incompatible or immiscible with the host polymer. Immiscibility results in the formation of discrete domains of the copolymer and/or backbone grafted polymer within the host polymer. The host polymer thus forms a continuous phase and the copolymer and/or backbone grafted polymer being a discontinuous phase. The existence of discrete domains within the host polymer can result in a material having reduced tenacity, tensile modulus and/or increased opacity. Therefore, there exists a need for polymeric material having good electret stability with improved strength. Further, there exists a need for such highly charged materials that are capable of substantially maintaining its initial charge over time.

Unlike polymers having functional moieties added by copolymerization or backbone grafting, the term "telomer" or "telechelic" polymer refers generally to polymers having a reactive or functional end group. Telomers are known in the art and methods of making the same are described in U.S. Pat. Nos. 4,342,849 and 5,405,913 and Japanese 08/067704A2. Such polymers have traditionally referred to those polymers that contain a functional end group which can selectively react with or bond with another molecule. Telomers or telechelic polymers have heretofore been used as additives in various systems to impart additional adhesive or cross-linking properties to the same. In this regard, telomers have been used as a cross-linkable coating by incorporating reactive end groups. As an example, polyamide telomers having aryloyl end groups undergo cross-linking upon exposure to electron-beam radiation. Also, telomers have been added to adhesives systems in order to improve their function. For example, polyurethane polymer adhesives for bonding of metals exhibit higher peel strengths upon addition of phosphorous containing telomers. Telomers have also been used as processing aids for plasticizers and other materials. For example, processability of ethylene-propylene rubbers is said to be improved when various telomeric materials are added. Telomers have also been used as surfactants, biocidal agents, lubricants and other uses, examples of which are described in the *Encyclopedia of Polymer Science and Engineering*, vol. 16, pg. 549–551 (1989).

SUMMARY OF THE INVENTION

The problems experienced by those skilled in the art are overcome by the present invention which comprises an electret material comprising a blend of a first thermoplastic polymer and a substantially compatible telomer. In a further aspect of the present invention, an electret material is provided comprising a porous substrate such as a nonwoven web of thermoplastic polymer fibers having a permanent or stabilized charge contained therein and wherein at least a portion of the fibers comprise a blend of a first thermoplastic polymer and a telomer compatible with the first thermoplastic polymer. The telomer desirably comprises from about 0.1 to about 25% by weight of the polymeric portion of the film or fiber and even more desirably from about 0.5% to about 15% of the polymeric portion of the film or fiber. In a further aspect, the telomer desirably comprises a backbone substantially similar to that of the first thermoplastic polymer component. As an example, the porous substrate can be a nonwoven web of fibers which comprise from about 90% to about 99%, by weight, polypropylene and from about 1%–10%, by weight, polypropylene backbone with one or more functional end groups.

DESCRIPTION OF THE INVENTION

Figure 1:
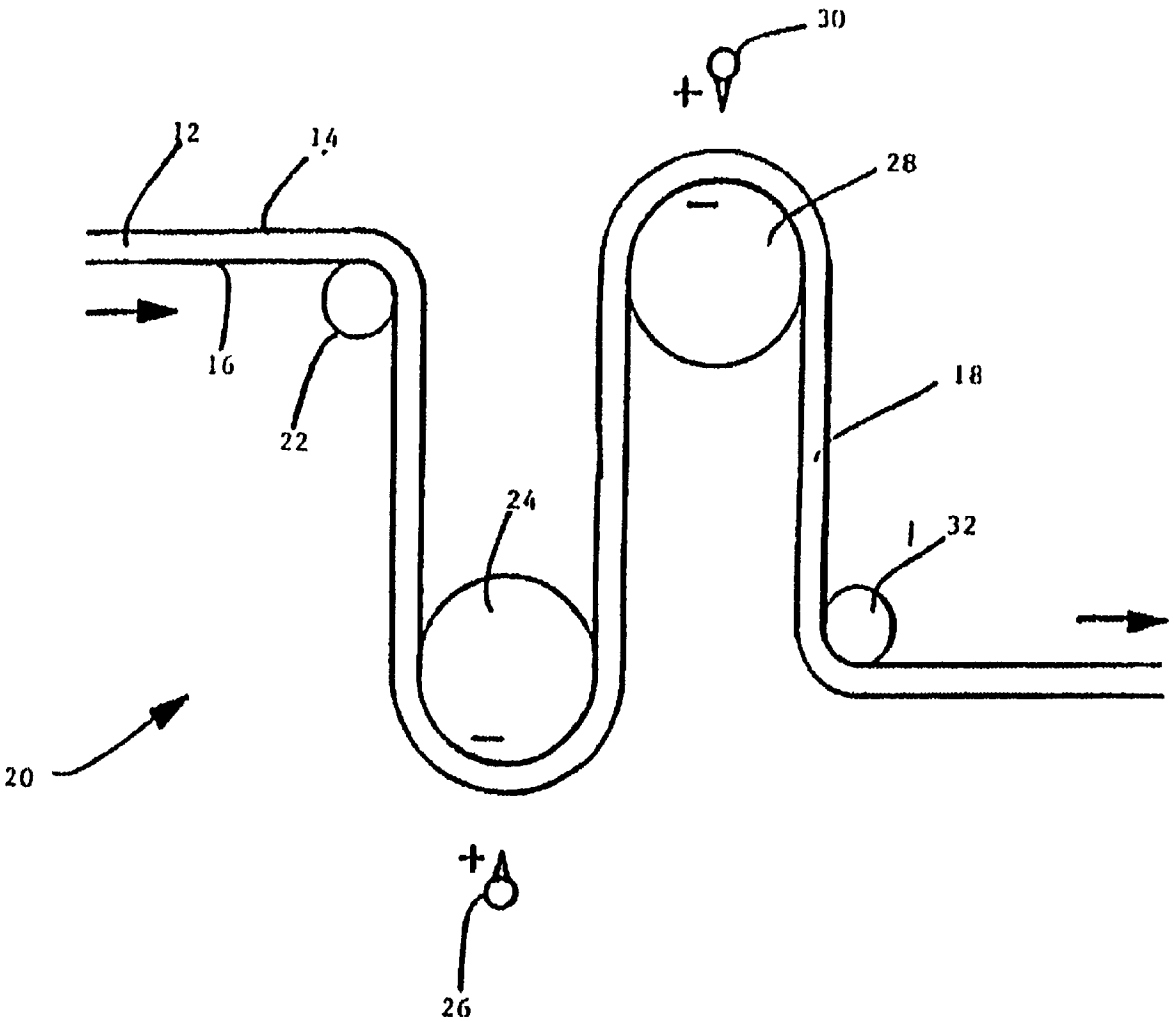
FIG. 1 is a schematic diagram of a process line for electret treating polymeric materials.

Polymeric electret materials or articles of the present invention comprise, at least in part, a material comprising a blend or mixture of (a) a first thermoplastic polymer and (b) a telomer which is substantially compatible with the first thermoplastic polymer. As used herein "telomeric" polymer or "telomer" comprise polymers having one or more functional groups located at the chain ends of the polymer. The telomeric polymer can be a homopolymer, copolymer, terpolymer or other composition. However, with copolymers or other polymers with a plurality of repeat units, the terminal or end functional groups of the telomers do not have the same chemical functionality as the repeat units. Telomers can have either one or a plurality of functional end groups and the average number of functional end groups for a given telomer will vary with the method of formation, degree of chain branching and other factors known to those skilled in the art. The telomer is desirably present in an amount of from about 0.1% to about 20% of the total weight of the polymeric portion of the material and even more desirably comprises from about 0.5% to about 10%. In a preferred embodiment, polymeric electret material comprises from about 95% to about 99% of a host thermoplastic polymer and from about 1% to about 5% of a telomer. In a further aspect of the invention, the functional end groups desirably comprise a weight percent of between about 0.0004% and about 0.2% and even more desirably between 0.002% and 0.1% by weight.

Suitable thermoplastic polymers or "host" polymers include, but are not limited to, polyolefins (e.g., polypropylene and polyethylene), polycondensates (e.g., polyamides, polyesters, polycarbonates, and polyarylates), polyols, polydienes, polyurethanes, polyethers, polyacrylates, polyacetals, polyimides, cellulose esters, polystyrenes, fluoropolymers, and polyphenylenesulfide and so forth. As used herein and throughout the term "polymer" generally includes but is not limited to, homopolymers, copolymers, such as for example, block, graft, random and alternating copolymers, terpolymers, etc. and blends and modifications thereof. Furthermore, unless otherwise specifically limited, the term "polymer" includes all possible spatial or geometrical configurations of the molecule. These configurations include, but are not limited to isotactic, syndiotactic and random symmetries. Desirably, the first thermoplastic polymeric component comprises a non-polar polymer such as a polyolefin and, still more desirably, polyethylene, polypropylene, poly(1-butene), poly(2-butene), poly(1-pentene), poly(2-pentene), poly(1-methyl-1-pentene), poly (3-methyl-1-pentane), and poly(4-methyl-1-pentane) and so forth. The major portion of the thermoplastic polymer matrix can comprise a blend or mixture of two or more polymers. As an example, the major portion of the polymeric matrix can comprise polymer blends and, preferably, polyolefin polymer blends such as, for example, the polypropylene/polybutylene blends, such as those described in U.S. Pat. No. 5,165,979 to Watkins et al. and U.S. Pat. No. 5,204,174 to DaPonte et al., and polypropylene/poly-1-methyl pentene blends. The selection of the specific polymer or polymers will vary with respect to the chosen process for making the porous polymeric material. As an example, the desired polymer rheology is different for those used for making films as opposed to fibers and further, with respect to fiber forming processes, the desired polymer composition and rheology differs for polymers used for making spunbond fibers and those for making meltblown fibers. The desired polymer composition and/or rheology for a particular manufacturing process are known to those skilled in the art.

The telomer is desirably substantially compatible with the host polymer. As used herein "substantially compatible" means mixtures or blends of polymers wherein the composition produces a single DSC melting curve (determined by evaluating a composition by differential scanning calorimetry (DSC)) which is indicative of sufficient compatibility or miscibility to avoid formation of substantially discrete domains within the continuous phase of the host polymer. Desirably, the telomer has a chain or backbone which is substantially similar to one or more of the host polymers. Still more desirably, both the first thermoplastic polymer and the telomer can comprise polymers having a substantial fraction of the same monomeric units. As a specific example, the first thermoplastic polymer can comprise a polymer comprising a significant fraction of propylene repeat units and the second polymer comprises a compatible telomer that comprises a significant fraction of propylene repeat units. The functional end groups of the telomers are desirably end groups capable of hydrogen bonding or undergoing a reaction, such as a condensation reaction, to form a covalent bond. Generally, polar functional groups are desirable such as, for example, an aldehyde, acid halide, acid anhydrides, carboxylic acids, acrylates, amines, amine sans, amides, sulfonic acid amides, sulfonic acid and salts thereof, thiols, epoxides, alcohols, acyl halides, and derivatives thereof. Particularly preferred telomers include, but are not limited to, acid anhydride, carboxylic acid, amides, amines, and derivatives thereof.

Telomers and telechelic polymers are known in the art and various telomers and methods of making the same are described in *Encyclopedia of Polymer Science and Engineering*, vol. 16, pg. 494–554 (1989); the particular method utilized in making the telomer is not believed critical to practicing the present invention. As an example, telomers can be made by reactive grafting. In this regard, the desired polymer chains can be broken by peroxide cracking in the presence of the selected functional end group monomer. Peroxide cracking generates a free radical chain end that reacts with the functional groups and which thereby becomes the terminal or end group of the polymer chain. As particular examples, polyolefin-anhydride telomers (a polyolefin polymer having one or more anhydride end groups) suitable for use with the present invention are commercially available from Exxon Chemical Company of Houston, Tex. under the trade name EXXELOR and from Uniroyal Chemical Company under the trade name POLYBOND. The desired polymer composition and rheology will be selected in accord with the particular manufacturing process of the polymeric material. The telomer desirably has a melt flow rate (MFR) and/or melt-index (MI) which is compatible with the selected formation process. By utilizing a telomeric polymer with similar rheological properties, such as MI or MFR, it is believed a more homogeneous blend can be produced and processing will generally be improved. However, the criticality in matching or using telomers with specific properties will vary with the particular process employed. Generally speaking, the weight percent and MFR of telomer is desirably such that the average MFR of the blend does not impede the desired throughputs and/or fiber formation.

The telomer is desirably mixed with the host polymer(s) in a manner designed to achieve a substantially homogeneous blend. As one example, the polymers can be blended using a master batch or dry blend technique. In this regard, the telomer is initially blended with the host polymer to form a master batch, typically in the form of pellets, prills or powder, having a higher weight percent of telomer than ultimately desired in the polymeric portion of the polymeric media. The master batch is then mixed with pellets comprising the host polymer and processed through a single-screw extruder. The ratio of the master batch and host polymer is selected, based upon the weight percent of telomer in the master batch, to achieve the desired ratio of host polymer to telomer. Other blending techniques are also believed suitable for use with the present invention.

The polymers can be processed by one of various means to form the desired polymeric material. The polymeric electret material preferably comprises a porous material and/or structure. As used herein, the term "porous" substrate or material means a material that has open areas located therein which extend through the thickness of the material. Desirably the porous material has numerous interstitial spaces located between the material's surface which do not form direct passageways through the thickness of the material and instead collectively form tortuous pathways through the thickness of the material via adjacent, inter-connecting spaces or openings. Examples of suitable porous polymeric materials or media include, but are not limited to, striated or fibrillated films, woven fabrics, foams, nonwoven webs, sintered porous materials and the like. In this regard, nonwoven webs and laminates thereof, such as those described below, are particularly well suited for use as filtration materials and wipes. As used herein the term "nonwoven" fabric or web means a web having a structure of individual fibers or threads which are interlaid, but not in an identifiable manner as in a knitted fabric. Nonwoven fabrics or webs can be formed by many processes such as for example, meltblowing processes, spunbonding processes, hydroentangling, air-laid and bonded carded web processes.

As a specific example, meltblown fiber webs have been used in various filtration and air masking articles. Meltblown fibers are generally formed try extruding a molten thermoplastic material through a plurality of fine, usually circular, die capillaries as molten threads or filaments into converging high velocity, usually hot, gas (e.g. air) streams which attenuate the filaments of molten thermoplastic material to reduce their diameter. Thereafter, the meltblown fibers can be carried by the high velocity gas stream and are deposited on a collecting surface to form a web of randomly dispersed meltblown fibers. Meltblown processes are disclosed, for example, in U.S. Pat. No. 3,849,241 to Butin et al., U.S. Pat. No. 3,959,421 to Weber et al., U.S. Pat. No. 5,652,048 to Haynes et al., and U.S. Pat. No. 4,100,324 to Anderson et al.; and U.S. Pat. No. 5,350,624 to Georger et al.; the entire content of the aforesaid patents are incorporated herein by reference. Meltblown fiber webs having a basis weight from about 14–170 grams per square meter (gsm) and even more desirably between about 17 gsm and about 136 gsm are particularly well suited for use as filtration media. Additionally, meltblown fiber webs having small average fiber diameter and pore size, such as those described in U.S. Pat. No. 5,721,883 to Timmons et al., are particularly well suited for use in filtration applications.

In addition, various spunbond fiber webs are also capable of providing good filtration or air-masking media. Methods of making suitable spunbond fiber webs include, but are not limited to, U.S. Pat. No. 4,340,563 to Appel et al., U.S. Pat. No. 3,802,817 to Matsuki et al., and U.S. Pat. No. 5,382,400 to Pike et al. Spunbond fiber webs particularly well suited for use as filtration media are described in U.S. Pat. No. 5,709,735 to Midkiff et al., U.S. Pat. No. 5,597,645 to Pike et al., U.S. Pat. No. 5,855,784 to Pike et al., PCT Application No. U.S.94/12699 (Publication No. WO95113856) and PCT Application No. U.S.96/19852 (Publication No. WO97/23246); the entire content of the aforesaid references are incorporated herein by reference. With respect to multicomponent fibers, the telomer polymer blend can comprise either one or more components within the fiber. In this regard it is noted that the degree or tendency of bicomponent fibers to form latent crimp can be affected when utilizing a telomer blend in such fibers. Spunbond fiber webs suitable for use with the present invention desirably have a basis weight between about 14 $g/m^2$ and about 170 $g/m^2$ and more desirably between about 17 $g/m^2$ and about 136 $g/m^2$.

Staple fiber webs, such as air-laid or bonded/carded webs, are also suitable for formation of polymeric electret materials of the present invention. An exemplary staple fiber web is described in U.S. Pat. No. 4,315,881 to Nakajima et al.; the entire content of which is incorporated herein by reference. Staple fibers comprising the telomer polymer blend can comprise a portion of or all of the staple fibers within the staple fiber web. As still further examples, additional polymeric media suitable for use with the present invention include multilayer laminates. As used herein "multilayer nonwoven laminate" means a laminate comprising one or more nonwoven layers such as, for example, wherein at least one of the layers is a spunbond fiber web and/or at least one of the layers is a meltblown fiber web. As a particular example, an exemplary multilayer nonwoven laminate comprises a spunbond/meltblown/spunbond (SMS) laminate. Such a laminate may be made by sequentially depositing onto a moving forming belt a first spunbond fabric layer, then a meltblown fabric layer and a second spunbond layer. The multiple layers can then be bonded, such as by thermal point bonding, to form a cohesive laminate. Alternatively, one or more of the fabric layers may be made individually, collected in rolls, and combined in a separate bonding step. Examples of multilayer nonwoven laminates are disclosed in U.S. Pat. No. 5,721,180 to Pike et al., U.S. Pat. No. 4,041,203 to Brock et al., U.S. Pat. No. 5,138;885 to Timmons et al. and U.S. Pat. No. 5,482,765 to Bradley et al. The polymer blend can comprise fibers in one or more of the layers of a multilayer laminate. Other media suitable for use with the present invention include, by way of further examples, filtration media described in U.S. Pat. Nos. 4,588,537 and RE 32,171.

The polymeric material is treated to become electrostatically polarized, i.e. to exhibit an electrostatic charge or field and thereby comprise an electret. In this regard it is noted that electrostatically charging the material can improve the filtration efficiency of the material. Various electret treatment techniques are known in the art and it is not believed that the method of electret treatment of the media is critical to the present invention and that numerous methods of electret treatment materials are suitable for use with the present invention. Suitable electret treating processes include, but are not limited to, plasma-contact, electron beam, corona discharge and so forth. Electrical or corona poled treatments can be applied either during and/or after the film formation or fiber spinning process. As examples thereof, methods for treating materials to form electrets are disclosed in U.S. Pat. No. 4,215,682 to Kubic et al., U.S. Pat. No. 4,375,718 to Wadsworth et al., U.S. Pat. No. 4,588,537 to Klaase et al., U.S. Pat. No. 4,592,815 to Makao, and U.S. Pat. No. 5,401,446 to Tsai et al., the entire contents of the aforesaid patents are incorporated herein by reference.

As one example, a filter or air-masking media can be charged or electretized by sequentially subjecting the material, such as a nonwoven web, to a series of electric fields such that adjacent electret fields have opposite polarities with respect to one another. For example, a first side of the web is initially subjected to a positive charge while the second or opposed side is subjected to a negative charge, and then the first side is subjected to a negative charge and the second side to a positive charge thereby imparting permanent electrostatic charges in the material. A suitable method of electrostatically polarizing a polymeric material such as a nonwoven web is illustrated in FIG. 1. Polymeric sheet 12, having first side 14 and second side 16, is received by electret treatment apparatus 20. Polymeric sheet 12 is directed into apparatus 20 with second side 16 in contact with guiding roller 22. First side 14 of sheet 12 comes in contact with first charging drum 24, having a negative electrical potential, while second side 16 of sheet 12 is adjacent first charging electrode 26, having a positive electrical potential. As sheet 12 passes between first charging drum 24 and first charging electrode 26, electrostatic charges develop therein. The polymeric sheet 12 is then passed between second charging drum 28 and second charging electrode 30. Second side 16 of sheet 12 comes in contact with second charging drum 28, having a negative electrical potential, while first side 14 of sheet 12 is adjacent second charging electrode 30, having a positive electrical potential. The second treatment reverses the polarity of the electrostatic charges previously imparted within the web and creates a permanent electrostatic charge therein. The polarities of the charging drums and electrodes could be reversed. The electretized web 18 can then be passed to second guiding roller 32 and removed from electret treatment apparatus 20. Additionally, other devices or apparatus could be utilized in lieu of those discussed in reference to FIG. 1.

While the inventors do not which to be bound by a particular theory, it is believed that an electret polymeric material of the present invention provides improved charge density, stabilization and/or longevity. Thermoplastic polymers, even when above the glass transition temperature, are not 100% crystalline and instead comprise regions of both crystalline and non-crystalline (i.e. amorphous) structure. It has previously been proposed that charges, such as those induced by electrical or corona poled treatment, are supported at or near the interface between these crystalline and amorphous regions. This theory may explain the charge or electron flow induced by electretized materials above the glass transition temperature ($T_g$). The telomer blends of the present invention help stabilize the charge by providing mechanical stability to the amorphous regions and in particular those regions at or near the crystalline/amorphous region interface. Copolymers or backbone-grafted polymers, e.g. polyolefin polymers grafted with polar groups along the chain or backbone, have been utilized in electret filter media. Such polymers tend to be incompatible with the host polymer due to the size and chemical nature of the functional groups positioned along the polymer backbone. Thus, grafted polymers of this type can form discrete phases or regions and do not become well distributed throughout the material and are likened to fibers of biconstituent polymer blends which do not have a substantially homogeneous structure and instead form fibrils or protofibrils which start and end at random. Unlike such backbone-grafted polymers, telomers primarily comprise a polymer chain or backbone that is compatible with the host polymer and thus is capable or being Incorporated within the crystalline regions. Although the backbone or chain of the telomer can become incorporated within the crystalline regions the functional ends will remain in the amorphous region due to their size and/or polarity. Thus, the functional chain ends within the amorphous regions will, by hydrogen bonding or covalent bonding, provide additional mechanical stability to the interface between the crystalline and amorphous regions and hence provide improved charge formation and stability. Additionally, due to the ability of telomers to thoroughly intermingle with the host polymer, materials formed therefrom exhibit properties resembling a homopolymer fiber as opposed to a biconstituent fiber. A fiber or other material can therefore be provided having improved electrostatic properties without the degradation or loss of fiber strength or durability associated with biconstituent fibers. Although telomers have melting points distinct from those of their host polymers, telomer blends and materials incorporating the same exhibit a single melting curve under differential scanning calorimetry (DSC) which is indicative of the high degree of blending and homogeneous nature of the material.

Electret materials of the present invention can be used to make a variety of products and/or articles. As used herein the term "filtration" or "filter" media can refer to fabric which provide a desired level of barrier properties and is not limited to the strict or narrow definition of a filter which requires entrapment of particles. Thus, filter media of the present invention can be used in air and gas filtration media such as, for example, those used in HVAC filters, vacuum cleaner bags, respirators, air filters for engines, air filters for cabin air filtration, heating and/or air conditioner filters, etc. Additionally, the filter media of the present invention can also be utilized in infection control products such as, for example, medically oriented items such as surgical gowns and drapes, face masks, head coverings like bouffant caps, surgical caps and hoods, footwear like shoe coverings, boot covers and slippers, wound dressings, sterilization wraps and the like. As a particular example, exemplary sterilization wraps and face masks are described in U.S. Pat. No. 4,969,457 to Hubbard et al., U.S. Pat. No. 5,765,556 to Brunson, and U.S. Pat. No. 5,635,134 to Boume et al., the entire contents of the aforesaid references are incorporated herein by reference. Further, electret filter media can be utilized in hand wipes and other similar applications. In this regard, the electret media can be particularly adept at picking up lint, dust and other fine particulate matter. Polymeric electret materials can comprise or be incorporated as a component within in a wide variety of articles.

TESTS

Air Filtration Measurements: The air filtration efficiencies of the substrates discussed below were evaluated using a TSI, Inc. (St. Paul, Minn.) Model 8110 Automated Filter Tester (AFT). The Model 8110 AFT measures pressure drop and particle filtration characteristics for air filtration media. The AFT utilizes a compressed air nebulizer to generate a submicron aerosol of sodium chloride particles which serves as the challenge aerosol for measuring filter performance. The characteristic size of the particles used in these measurements was 0.1 micrometer. Typical airflow rates were between 31 liters per minute and 33 liters per minute. The AFT test was performed on a sample area of about 140 $cm^2$. The performance or efficiency of a filter medium is expressed as the percentage of sodium chloride particles that penetrate the filter. Penetration is defined as transmission of a particle through the filter medium. The transmitted particles were detected downstream from the filter. The percent penetration(% P) reflects the ratio of the downstream particle count to the upstream particle count. Light scattering was used for the detection and counting of the sodium chloride particles. The percent efficiency ($\epsilon$) may be calculated from the percent penetration according to the formula:

$$\epsilon = 100 - \% P.$$

Example 1

Blends of a thermoplastic host polymer and a thermoplastic telomer were prepared by conventional melt compounding techniques. A blend was prepared by first dry blending pellets or prills of the thermoplastic host polymer with pellets or prills of the telomer. A 20 weight percent masterbatch of the polypropylene-maleic anhydride telomer (EXXELOR PO 1015 from Exxon Chemical Company, Houston, Tex.) and polypropylene (Mantel PROFAX PF-015 from Mantel Polymers, Wilmington, Del.) was prepared by tumble blending 20 lbs. of EXXELOR PO 1015 with 80 lbs. of Mantel PROFAX PF-015. The dry blend was then melt compounded using a single screw compounding extruder. The 20 weight percent melt compounded blend was pelletized and used in turn to melt compound a series of lower concentration telomer blends described below. The polymeric component of the control comprised 100% by weight polypropylene (Montel PROFAX PF-015).

Telomer/thermoplastic polymer blends were formed into nonwoven fabrics on a meltblowing line. Typically, the polypropylene-maleic anhydride telomer/polypropylene blends were meltblown to form nonwoven fabrics approximately 20 inches (about 51 cm) in width. Meltblowing conditions were maintained the same for all materials made during a particular production period. The line speed was varied to alter basis weight. Basis weights of 0.5 ounces per square yard or osy (about 17 grams per square meter or gsm), 0.75 osy (about 25 gsm), 1.0 osy (about 34 gsm), and 1.5 osy (about 51 gsm) were spun from PROFAX PF-015 alone (the control) and from the 1 weight percent and 10 weight percent EXXELOR PO 1015 and PROFAX PF-015 blends.

The nonwoven fabrics described above were electret treated on-line in accordance with the teachings of U.S. Pat. No. 5,401,446 to Tsai et al. On-line electret treatment of the meltblown fabrics necessitated changing the rate at which the nonwoven web passed through the treatment zones to accommodate the line speed needed to produce fabric having various basis weights. In general, line speeds varied from 30 ft/min (about 15 cm/sec) to 100 ft/min (about 51 cm/sec), corresponding to nonwoven materials ranging in basis weight from 0.5 ounces per square yard or osy (about 17 $g/m^2$) to 1.5 osy (about 51 $g/m^2$).

Figure 2:
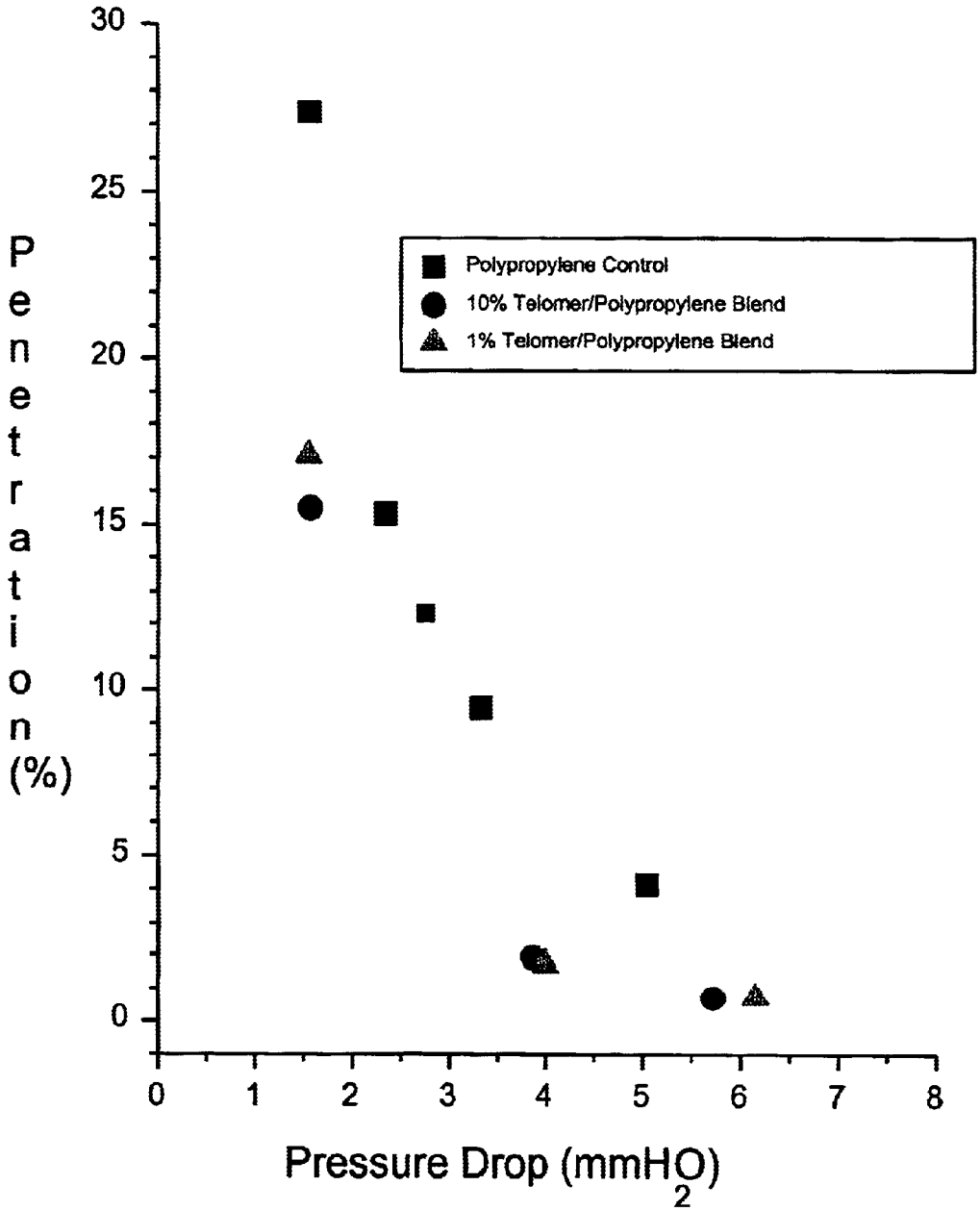
FIG. 2 is graph plotting percent penetration versus pressure drop of various electret treated meltblown fiber webs.

The air filtration efficiencies for meltblown nonwoven webs prepared from PROFAX PF-015 polypropylene alone and the 1%, by weight, and 10%, by weight, blends of EXXELOR PO 1015 and PROFAX PF-015 are shown in Tables 1 through 3 and FIG. 2.

TABLE 1

Air Filtration Results for Polypropylene Control Webs

| Basis Weight (osy) | Pressure Drop (mm $H_2O$) | Penetration (%) |
|---|---|---|
| 0.5 | 1.6 | 27.4 |
| 0.75 | 2.3 | 15.3 |
| 1.0 | 3.3 | 9.5 |
| 1.5 | 5.0 | 4.1 |

TABLE 2

Air Filtration Results for 1 Weight % Telomer/Polypropylene Webs

| Basis Weight (osy) | Pressure Drop (mm $H_2O$) | Penetration (%) |
|---|---|---|
| 0.5 | 1.6 | 17.0 |
| 1.0 | 4.0 | 1.7 |
| 1.5 | 6.2 | 0.7 |

TABLE 3

Air Filtration Results for 10 Weight % Telomer/Polypropylene Webs

| Basis Weight (osy) | Pressure Drop (mm $H_2O$) | Penetration (%) |
|---|---|---|
| 0.5 | 1.6 | 15.5 |
| 1.0 | 3.9 | 1.9 |
| 1.5 | 5.7 | 0.7 |

The data of Tables 1 through 3 illustrate that the addition of the telomer (EXXELOR PO 1015) significantly improves the initial air filtration efficiency of electret treated meltblown webs. This is also illustrated by the graph in FIG. 2. Notably, for any given pressure drop webs containing 1% or 10%, by weight, telomer evidence lower average particle penetrations compared to the control. In other words, the filtration efficiency of webs containing 1% or 10%, by weight, of the telomer (EXXELOR PO 1015) is greater than the filtration efficiency of webs containing only polypropylene.

Example 2

The meltblown nonwoven webs described in this example were prepared and treated using substantially the same procedure described in Example 1 except as noted below. In addition to the melt compounded materials, polypropylene (PROFAX PF-015) was dry blended with EXXELOR PO 1015 and fed directly to the extruder hopper for the meltblown line. In this way a 1%, by weight, and 5%, by weight, dry blends were intermixed with the host polymer during the meltblowing process.

The air filtration efficiencies for meltblown webs prepared from PROFAX PF-015 polypropylene alone (control) and the blends of EXXELOR PO 1015 and PROFAX PF-015 polypropylene are shown in Tables 4 through 8 and FIG. 2.

TABLE 4

Air Filtration Results for Polypropylene Control Webs

| Basis Weight (osy) | Pressure Drop (mm $H_2O$) | Penetration (%) |
|---|---|---|
| 0.5 | 1.2 | 35.9 |
| 0.6 | 1.8 | 21.8 |
| 0.75 | 2.3 | 15.6 |
| 1.0 | 2.9 | 9.4 |
| 1.5 | 3.9 | 9.0 |

TABLE 5

Air Filtration Results for 1 Weight % Telomer/Polypropylene Webs Melt Compounded Blend

| Basis Weight (osy) | Pressure Drop (mm $H_2O$) | Penetration (%) |
|---|---|---|
| 0.5 | 0.9 | 31.0 |
| 0.6 | 1.2 | 18.9 |
| 0.75 | 1.6 | 13.2 |
| 1.0 | 2.1 | 7.0 |
| 1.5 | 2.8 | 6.1 |

TABLE 6

Air Filtration Results for 1 Weight % Telomer/Polypropylene Webs Dry Blend

| Basis Weight (osy) | Pressure Drop (mm $H_2O$) | Penetration (%) |
|---|---|---|
| 0.5 | 0.8 | 34.9 |
| 0.6 | 1.2 | 24.4 |
| 0.75 | 1.6 | 16.2 |
| 1.0 | 2.1 | 9.4 |
| 1.5 | 2.9 | 6.4 |

TABLE 7

Air Filtration Results for 5 Weight % Telomer/Polypropylene Webs Melt Compounded Blend

| Basis Weight (osy) | Pressure Drop (mm $H_2O$) | Penetration (%) |
|---|---|---|
| 0.5 | 1.0 | 22.6 |
| 0.6 | 1.4 | 15.7 |
| 0.75 | 1.8 | 10.9 |
| 1.0 | 2.6 | 4.9 |
| 1.5 | 3.1 | 4.5 |

TABLE 8

Air Filtration Results for 5 Weight % Telomer/Polypropylene Webs Dry Blend

| Basis Weight (osy) | Pressure Drop (mm $H_2O$) | Penetration (%) |
|---|---|---|
| 0.5 | 1.0 | 25.3 |
| 0.6 | 1.4 | 16.2 |
| 0.75 | 1.9 | 9.7 |
| 1.0 | 2.6 | 5.1 |
| 1.5 | 3.2 | 4.5 |

The data of Tables 4 through 8 illustrate that the addition of 1%, by weight, or 5%, by weight, of the telomer-greatly improves the initial filtration efficiency of corona poled meltblown webs. In addition, it appears that sufficient mixing of the telomer and host polymer occurs during the melt processing that immediately precedes meltblowing and fabric formation. Filtration data collected from webs prepared from the melt compounded telomer display equivalent filtration efficiency to webs prepared after melt processing a dry blend of the telomer and the host polymer.

Example 3

The meltblown nonwoven webs described in Example 1 were analyzed by differential scanning calorimetry (DSC). Differential scanning calorimetry is a thermal analysis technique which allow one to examine the thermal properties of a polymer over a wide range of temperatures. For the purpose of this example, small samples of each of the meltblown nonwoven webs of Example 1 (about 5 milligrams) were analyzed by DSC over the temperature range from 0° C. (32° F.) to 225° C. (about 437° F.). The DSC measurements were made using a Mettler Differential Scanning Calorimeter (Toledo, Ohio) at a heating rate of 20° C. per minute. A sample of pure EXXELOR PO 1015 was also analyzed by DSC over the same temperature range. The DSC analysis revealed the melting point behavior of each material. The melting points are summarized to Table 9.

TABLE 9

Melting Point Temperature for Meltblown Nonwoven Webs Measured by Differential Scanning Calorimetry

| Sample Identification | Melting Point (° C.) |
|---|---|
| Exxelor PO 1015 | 145 |
| Polypropylene Control | 161 |
| 1 weight % Exxelor PO 1015/ Polypropylene Blend | 162.9 |
| 10 weight % Exxelor PO 1015/ Polypropylene Blend | 162.5 |

The data in Table 9 indicates that each material exhibited a single melting transition. Notably, the telomer (EXXELOR PO 1015) melts at a lower temperature that the polypropylene host polymer. The DSC analysis of the 1% and 10% EXXELOR PO 1015/polypropylene blend revealed only a single melting transition very close to the melting point of the pure polypropylene. This indicates that the telomer is intimately blended with the host polymer, and further suggests that the telomer crystallized to form a single domain with the polypropylene rather that a separate telomer rich crystalline domain. If the telomer was segregated into distinct telomer rich crystalline domains, one skilled in the art would expect the DSC to reveal a melting transition dose to that of the pure telomer. The DSC suggests that the polymer fibers which make up the meltblown nonwoven are composed of amorphous and one type of crystalline domain, wherein the telomer is incorporated into the crystalline polypropylene domains.

Example 4

Blends of a thermoplastic host polymer and a thermoplastic telechelic polymer were made using a volumetric feed system that was an integral part of a side-by-side A:B bicomponent spunbond machine. The addition rate of the telechelic polymer was controlled to produce a 11%, by weight, blend of the telechelic polymer in the host polymer. The host polymer was polypropylene (Exxon 3155 from Exxon Chemicals, Houston, Tex.) and the telechelic polymer was a polypropylene-maleic anhydride telomer (POLYBOND 3150 from Uniroyal Chemical Company, Inc., Middlebury, Conn.). The "A-side" was the telechelic blend described above and the "B-Side" was polyethylene (Dow XUS61800 polyethylene from Dow, Midland, Mich.). The control comprised a bicomponent side-by-side spunbond fiber having an "A-side" of polypropylene (Exxon 3155) and a "B-side" of polyethylene (Dow XUS61800).

Side-by-side bicomponent spunbond fabrics were made as described in U.S. Pat. No. 5,382,400. The basis weight of the spunbond nonwoven web described in this example was 2.0 osy (about 68 gsm). The spunbond nonwoven fabrics were electret treated as described in Example 1.

The air filtration efficiencies for side-by-side bicomponent spunbond filtration media are shown in Table 10. The basis weight of the filter media was 20 osy (about 68 gsm).

TABLE 10

Air Filtration Efficiencies for 2.0 osy Bicomponent Spunbond Webs

| Sample | Pressure Drop (mm $H_2O$) | Penetration (%) |
|---|---|---|
| Control | 0.150 | 42.7 |
| 1% Telomer | 0.180 | 32.6 |

The data presented in Table 10 indicates that the addition of 1% of the telomer (POLYBOND 3150) results in a 15% improvement in the initial filtration efficiency of bicomponent spunbond webs.

While various patents and other reference materials have been incorporated herein by reference, to the extent there is any inconsistency between incorporated material and that of the written specification, the written specification shall control. In addition, while the invention has been described in detail with respect to specific embodiments thereof, it will be apparent to those skilled in the art that various alterations, modifications and other changes may be made to the invention without departing from the spirit and scope of the present invention. It is therefore intended that the claims cover or encompass all such modifications, alterations and/or changes. Further, as used herein and throughout, the term "comprising" is inclusive or open-ended and does not exclude additional unrecited elements, compositional components, or method steps.

What is claimed is:

1. An electret comprising:

a porous polymeric material having an electrostatic charge; said porous polymeric material comprising a first thermoplastic polymer and from about 0.1% by weight to about 25% by weight of a miscible thermoplastic telomer having a functional end group selected from the group consisting of aldehyde, acid halide, acid anhydrides, carboxylic acids, amines, amine salts, amides, sulfonic acid amides, sulfonic acid and salts thereof, thiols, epoxides, alcohols, acyl halides, and derivatives thereof.

2. The electret of claim 1 wherein said telomer and said first thermoplastic polymer each comprise a polymer having a significant fraction of the same monomer.

3. The electret of claim 2 wherein said telomer comprises between 0.1% and about 20% of said polymeric material.

4. The electret of claim 3 wherein said telomer comprises between about 0.5% and 20% of said polymeric material.

5. The electret of claim 1 wherein said first thermoplastic polymer is selected from the group consisting of polyolefins, polyamides, polyesters, polyurethanes, polydienes, polyols, polyethers and polycarbonates.

6. The electret of claim 5 wherein said first thermoplastic polymer is selected from the group consisting of polyethylenes, polypropylenes, and nylons.

7. The electret of claim 5 wherein said first thermoplastic polymer and said telomer comprise a copolymer of propylene and ethylene.

8. The electret of claim 1 wherein said first thermoplastic polymer and said telomer each comprise a polymer having a significant fraction of propylene repeat units.

9. The electret of claim 8 wherein said first thermoplastic polymer and said telomer comprise a copolymer of propylene and a second repeat unit.

10. The electret of claim 1 wherein said porous material is selected from the group consisting of fibrillated films, sintered films, porous films, woven fabrics, foams, nonwoven webs and multilayer laminates thereof.

11. The electret of claim 1, wherein the porous material comprises a nonwoven web and wherein the first thermoplastic polymer is selected from the group consisting of polyolefin and polyamide polymers.

12. The electret of claim 11 wherein said nonwoven web comprises a meltblown fiber web.

13. The electret material of claim 12 wherein said first thermoplastic polymer and said telomer each comprise a polymer having a significant fraction of propylene monomer.

14. The electret of claim 13 wherein said telomer comprises a polypropylene polymer having functional end groups selected from the group consisting of acid anhydrides, carboxylic acids, amides, amines, and derivatives thereof, and wherein said telomer comprises between 0.5% and 20% by weight of said nonwoven web.

15. The electret of claim 11 wherein said nonwoven web is selected from the group consisting of meltblown fiber webs, spunbond fibers webs, hydroentangled webs, air-laid and bonded-carded webs.

16. The electret of claim 15 wherein fibers of said nonwoven web are formed from a blend of a first polypropylene polymer and a polypropylene telomer having at least one functional end group selected from the group consisting of carboxylic acids, acrylic acids and acrylates.

17. The electret of claim 11 wherein said nonwoven web comprises a spunbond fiber web.

18. The electret of claim 17 wherein said spunbond fiber web comprises multicomponent fibers and wherein at least one of the components of said multicomponent fiber comprises said telomer.

19. The electret of claim 11, wherein the first thermoplastic polymer and said telomer each comprise an olefin polymer having a major fraction of the same monomeric unit.

20. The electret of claim 11 wherein said first thermoplastic polymer and said telomer each comprise a polyolefin and further wherein said first thermoplastic polymer and said telomer each comprise a polymer having a significant fraction of propylene monomer.

21. A face mask comprising the electret material of claim 11.

22. A sterilization wrap comprising the electret material of claim 11.

23. A sterilization wrap comprising a spunbond/meltblown/spunbond laminate wherein at least one of said layers comprises the electret material of claim 11.

24. A dust wipe comprising the electret material of claim 11.

25. An air filter material comprising the electret material of claim 11.

* * * * *